United States Patent [19]

Todoroki et al.

[11] Patent Number: 4,531,988

[45] Date of Patent: Jul. 30, 1985

[54] THERMALLY ACTUATED DEVICES

[75] Inventors: Tsunehiko Todoroki, Kusatsu; Tadahiko Hayakumo; Katsumi Fukuda, both of Shiga, all of Japan

[73] Assignee: Matsushita Electric Industrial Co., Ltd., Kadoma, Japan

[21] Appl. No.: 619,272

[22] Filed: Jun. 11, 1984

[30] Foreign Application Priority Data

Jun. 13, 1983 [JP] Japan ..... 58-105174

[51] Int. Cl.[3] ..... C22C 14/00; C22C 19/03

[52] U.S. Cl. ..... 148/402; 148/11.5 F; 148/11.5 N

[58] Field of Search ..... 148/402, 11.5 N, 11.5 F

[56] References Cited

U.S. PATENT DOCUMENTS 3,948,688 4/1976 Clark ..... 148/402
4,405,387 9/1983 Albrecht et al. ..... 148/402
4,412,872 11/1983 Albrecht et al. ..... 148/402

FOREIGN PATENT DOCUMENTS 2117001 10/1983 United Kingdom ..... 148/402

*Primary Examiner*—Wayland Stallard
*Attorney, Agent, or Firm*—Wenderoth, Lind & Ponack

[57] ABSTRACT

A thermally actuated device comprising a shape memory alloy which has an improved temperature response. The shape memory alloy is combined with a bias load to provide a two-way action and the temperature-deflection relationship at an operating temperature range is such that the shear strain of the shape memory alloy corresponding to the point of transit from a first shape recovery process to a second shape recovery process resulting from the heating is smaller than that corresponding to the point of termination of a first strain induced process by the counteracting bias load resulting from the cooling. The difference between said two sheer strains is restricted to the range of operating strain of the shape memory alloy.

4 Claims, 8 Drawing Figures

THERMALLY ACTUATED DEVICES

BACKGROUND OF THE INVENTION

This invention relates to thermally actuated devices with accurate temperature response.

Thermally actuated devices which comprise a shape memory alloy (SMA) are well known. An excellent review about the industrial applications of the SMA material is given by C. W. Wayman, Journal of Metals, June, 1980. Among many SMA materials, Ti-Ni base alloys (which include Ti-Ni alloys according to U.S. Pat. No. 3,174,851, Ti-Ni-Co alloys and Ti-Ni-Fe alloys according to U.S. Pat. No. 3,558,369, and Ti-Ni-Cu alloy according to U.S. Pat. No. 4,144,057) are most practical.

The SMA material converts heat energy into mechanical energy directly. Two kinds of mechanical action "one-way" and "two-way" are known. One-way action involves that a shape change occurs only on heating. Two-way action involves that the shape change occurs both on heating and cooling.

In general, thermally actuated devices operable reciprocately are considered requiring the use of the SMA material capable of exhibiting the two-way action. The Ti-Ni system generally has a property of exhibiting the one-way action, but when combined with a bias load, it exhibits the two-way action. The general method for causing the two-way action of Ti-Ni base alloy is to:

(1) form an SMA helical coil of cold-drawn SMA wire;

(2) constrain the SMA helical coil as close state;

(3) anneal the SMA helical coil at about 500° C. (which is called memory anneal or imprinting anneal);

(4) cool the SMA helical coil to room temperature;

(5) remove the constraint; and (6) hang a bias load from the lower end of the SMA helical coil. The bias load means dead weight, bias spring, or other forces added against shape recovery direction.

On cooling below the transformation temperature range, the bias load produces a greater deflection of the SMA helical coil. On heating above the transformation temperature range, the SMA helical coil will contract to its imprinting close-coiled state. Therefore, we can get two-way action of the SMA helical coil.

In this two-way action, the transformation temperature range during the cooling and that during the heating do not match with each other, and the former is generally lower than the latter. This difference in transformation temperature range is called a temperature hysteresis.

According to the prior art, the temperature hysteresis has been 10° to 30° C. In addition, it has been found that, when the two-way action is repeated, the transformation temperature range tends to shift and deflection tends to increase, thereby reducing the recurring lifetime. These inferior properties have proven to be a major inhibiting factor in the development of a thermally actuated device comprising the SMA material with accurate temperature response.

SUMMARY OF THE INVENTION

The present invention is the outcome of research conducted on the two-way action of an SMA material to examine the behavior in a region of about 2% or less of the shear strain resulting from the deflection of the SMA material. In this region of shear strain, the two-way action between the temperature T1 below the transformation temperature and the temperature T2 above the transformation temperature generally exhibits such a temperature-deflection characteristic curve as shown in FIG. 1.

When the SMA material is heated, the transformation from the low temperature phase to the high temperature phase consists of two processes and the SMA material restores to its original shape through a first shape recovery process a and then through a second shape recovery process b. When it is cooled, the SMA material deflects, by the stress induced transformation, through a first stress induced process c and then through a second stress induced process d. The present invention is based on the newly discovered phenomenon and intended to provide a thermally actuated device comprising an SMA material, said device having its operating range limited to the range wherein the shear strain $\gamma A$ incident to the deflection of the SMA material at the point A of transit from the first shape recovery process a to the second recovery process b is smaller than the shear strain $\gamma B$ at the point B of termination of the first stress induced process c, and said SMA material having its range of deflection limited to lie between the shear strains $\gamma A$ and $\gamma B$. It is to be noted that the zero value of shear strain stands for the shape assumed by the SMA material at a high temperature T2 during the absence of any bias load.

By these limitations, it is possible to make the temperature hysteresis of the two-way action of the SMA material equal to or smaller than 3° C. and the thermally actuated device having a good thermal response and a good recurring lifetime can be realized.

The deformation mechanism in which the two-way action undergoes the two different process has not yet been clarified, but is inferred in such a way that the transformation from the rhombohedral phase to the CsCl type phase plays an important role in the first shape recovery process a, the transformation from the mono-clinic martensite phase to the CsCl type phase in the second shape recovery process b, the transformation from the CsCl type phase to the rhombohedral phase in the first stress induced process c, and the transformation from the rhombohedral phase to the mono-clinic martensite phase in the second stress induced process d.

BRIEF DESCRIPTION OF THE DRAWINGS

These and other objects and features of the present invention will be apparent upon consideration of the following detailed description taken together with the accompanying drawings, wherein.

DETAILED DESCRIPTION OF THE EMBODIMENT

Wires of 0.75 mm in diameter made of an Ni-Ti alloy as an SMA material having the transformation temperature within the range of 30° to 50° C. were used, it being to be noted that the transformation temperature is variable with the composition of the alloy, conditions for the heat treatment and/or the bias load. The wires were coiled to a close-coiled state having 5.6 mm in means coil diameter and were subsequently memory-annealed for 30 minutes at 425° C., 450° C., 475° C., and 500° C., respectively, to provide helical coil springs each having 16 turns in number of active coils.

Figure 2:
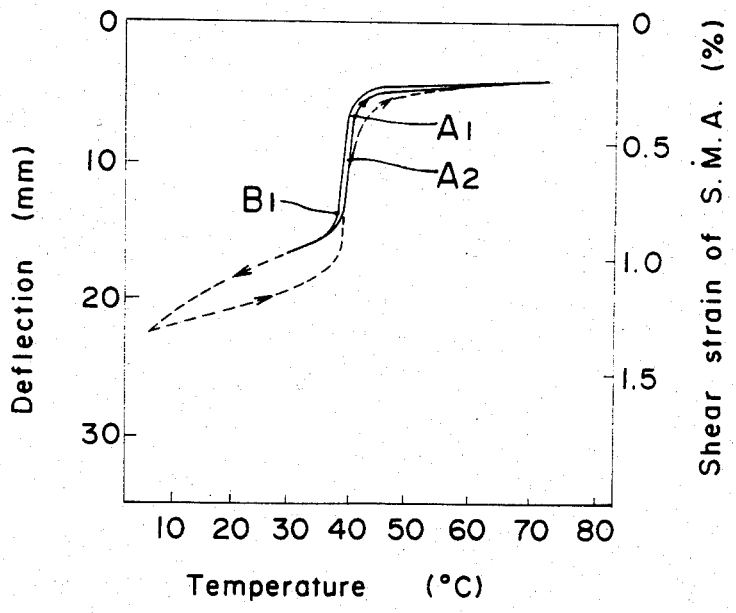
FIG. 2 shows a temperature-deflection loop of Ti-Ni alloy which was memory-annealed at 450° C.
Figure 3:
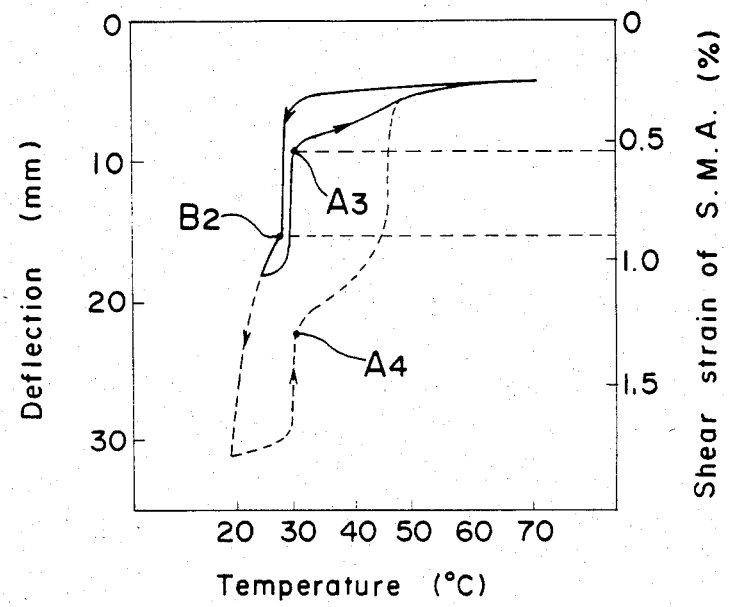
FIG. 3 shows a temperature-deflection loop of Ti-Ni alloy which was memory-annealed at 500° C.

While a weight was secured as a bias load to each of the SMA coil springs, the relationship between temperature and deflection was examined by heating and cooling them in the water, some of the results of which are shown in FIGS. 2 and 3, respectively.

It is to be noted that the deflection of an SMA coil spring is associated with the shear strain $\gamma$ of the wire used to make the SMA coil spring undergoing deflection, as expressed by the following equation:

$$\gamma = K\frac{d \times \delta}{\pi \times n \times D^2}$$

wherein d represents the wire diameter; D represents the mean coil diameter; n represents the number of active coils; and K is expressed as follows:

$$K = \left(\frac{4D}{d} - 1\right) \div \left(\frac{4D}{d} - 4\right) + \frac{0.615d}{d}$$

Although in the embodiment so far described the parameters d, D and n were chosen 0.75 mm, 5.6 mm and 16 turns, respectively, what is shown in FIGS. 2 and 3 can be equally exhibited by samples having the parameters different from that described above so far as the relationship between temperature and shear strain is concerned.

FIG. 2 illustrates the example wherein the SMA coil spring memory-annealed at 450° C. was combined with a bias load of 130 g. The solid line in FIG. 2 represents the temperature-deflection characteristic curve exhibited during the heating and cooling at respective temperatures between 30° to 70° C., wherein the second shape recovery process does not take place and the first shape recovery process terminates at the point A1. The broken line in FIG. 2, partially overlapping the 30° C.–70° C. curve, represents the temperature-deflection characteristic curve exhibited during the heating and cooling at respective temperatures between 5° to 70° C., wherein the first shape recovery process terminates at the point A2 and is followed by the second shape recovery process to attain 70° C. In both of them, the cooling process follows the same curve with the first stress induced process terminating at the point B1. The difference in temperature between the first shape recovery process during the heating and the first stress induced process during the cooling, that is, the temperature hysteresis, is as small as 1.5° C.

FIG. 3 illustrates the example wherein the SMA coil spring memory-annealed at 500° C. was combined with the bias load of 85 g. The solid line in FIG. 3 represents the temperature-deflection characteristic curve exhibited during the heating and cooling at respective temperature between 25° to 70° C., wherein the first shape recovery process terminates at the point A3 and is followed by the second shape recovery process to attain 70° C. The broken lines in FIG. 3, partially overlapping the 25° C.–70° C. curve, represents the temperature-deflection characteristic curve exhibited during the heating and cooling at respective temperatures between 19° and 70° C., wherein the first shape recovery process terminates at the point A4 and is followed by the second shape recovery process to attain 70° C. In both of them, the cooling process follows the same curve with the first stress induced process terminating at the point B2. In the 25°–70° C. curve, the temperature hysteresis is about 2.5° C. Similar results were obtained in the SMA coil springs memory-annealed at 425° C. and 475° C., respectively.

From the foregoing, it has been found that, in the two-way action of the SMA material combined with the bias load, the temperature-deflection relationship during the cooling follows the same route or process regardless of the minimum operating temperature, but that during the heating varies depending on the minimum operating temperature. In other words, the amount of deflection taking place during the first shape recovery process is not affected by the minimum operating temperature so much, but that during the second shape recovery process increases with decrease of the minimum operating temperature. Since the second shape recovery process takes place at a temperature higher than that at which the first shape recovery process takes place, the temperature hysteresis between the second shape recovery process and the first stress induced process during the cooling is very large.

Hereinafter, the manner in which the above discussed phenomenon appears in the actual thermally actuated device will be discussed.

Figure 4:
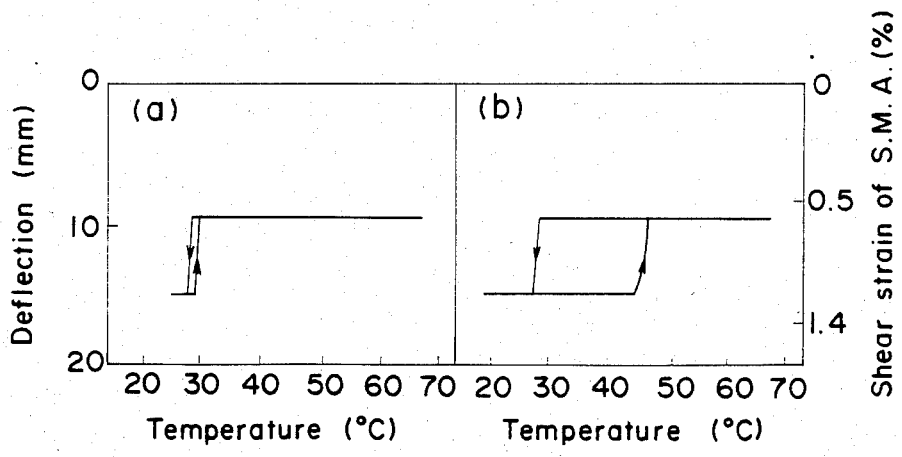
FIG. 4 shows temperature-deflection loops of Ti-Ni alloy being memory-annealed at 500° C., with restricted working distance, and minimum temperature of two-way action being 25° C. and 19° C. for a and b, respectively.

Let it be assumed that the device comprises a combination of the SMA material and the bias load designed so as to exhibit the characteristic curve shown in FIG. 3. In the actual thermally actuated device, a stopper means is utilized to restrict the extent to which the SMA coil spring elongates, that is, the operating range, to a value between $\gamma A3 = 0.55\%$ and $\gamma B2 = 0.90\%$ in terms of the shear strain. The temperature-deflection relationship exhibited by such a thermally actuated device is such as shown in FIG. 4. That is to say, when it is used in the minimum temperature range of 25° C., the relationship is such as shown in FIG. 4(*a*), giving the hysteresis of 2.5° C., but when it is used in the minimum temperature range of 19° C., the relationship is such as shown in FIG. 4(*b*) giving the hysteresis of about 18° C. In other words, referring to FIG. 3, the hysteresis corresponding to the hysteresis between the shear strain of 0.55% and that of 0.90% is exhibited.

Figure 1:
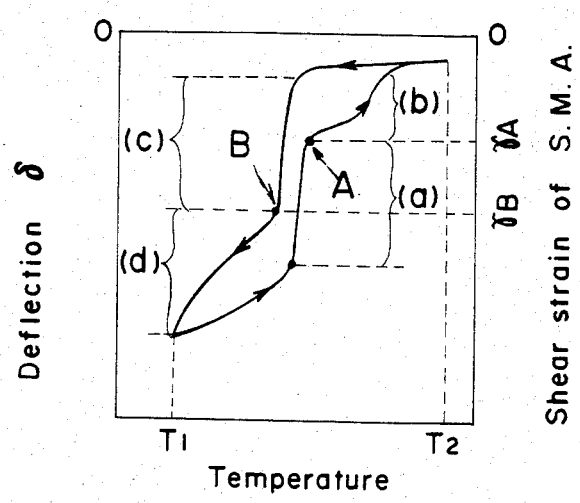
FIG. 1 shows schematically a temperature-deflection loop of two-way action including first shape recovery process a, second shape recovery process b, first stress induced process c and second stress induced process d.

As can be readily understood from the foregoing, in order to minimize the hysteresis exhibited by the thermally actuated device utilizing the combination of the SMA material and the bias load and capable of exhibiting the two-way action, it is important to limit the extent of elongation of the SMA coil spring in the light of the relationship between the load and the minimum temperature used. In other words, the thermally actuated device having the hysteresis of 3° C. or lower can be obtained if the temperature-deflection relationship (the shear strain of the SMA coil spring) exhibited within the operating temperature range relative to the load to the SMA material is determined such as shown in FIG. 1, the shear strain $\gamma A$ corresponding to the point A of transit from the first shape recovery process to the second shape recovery process during the heating is then rendered smaller than the shear strain $\gamma B$ corresponding to the point B of termination of the first stress induced process during the cooling, and the resultant difference between these shear strains is used as the operating range.

Figure 5:
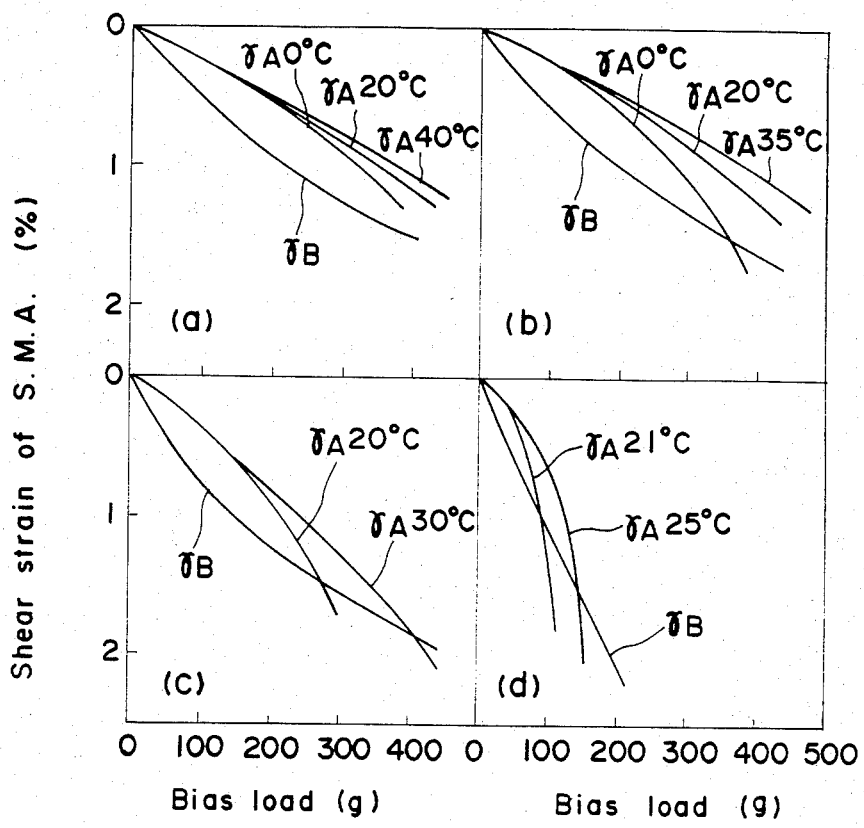
FIG. 5 shows shear strain of $\gamma A$ or $\gamma B$ versus bias load curves for four different memory-anneal of (a) 425° C., (b) 450° C., (c) 475° C. and (d) 500° C., respectively.

FIGS. 5(*a*), 5(*b*), 5(*c*) and 5(*d*) illustrate the relationships between the shear strains $\gamma A$ and $\gamma B$ exhibited by the Ni-Ti alloy coil springs memory-annealed at 425° C., 450° C., 475° C. and 500° C. and the bias load, respectively, it being to be noted that the minimum temperature used is used as a parameter and that the temperature shown at the right of each shear strain $\gamma A$ represents the minimum temperature.

In FIG. 5, if the SMA coil spring is utilized within the region bound by the shear strains $\gamma A$ and $\gamma B$ wherein the shear strain $\gamma A$ is smaller than the shear strain $\gamma B$, the thermally actuated device having the hysteresis of 3° C. or lower can be obtained. As can be understood from the drawings, the greater the bias load and the lower the minimum temperature used, the narrower the width of the range of the shear strain in which the SMA material exhibits a hysteresis of 3° C. or lower.

The thermally actuated device according to the present invention is such that, in order for it to satisfy the above described requirements, the operating range thereof is restricted. The method for restricting the operating range will now be described specifically by way of examples.

Figure 6:
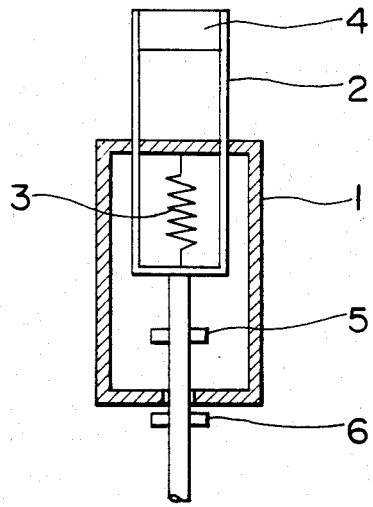
FIG. 6 shows a schematic representation of a thermally actuated device designed to restrict the working distance.

In the example shown in FIG. 6, there is shown a housing 1 having a movable body 2 incorporated therein for movement in a direction upwardly and downwardly. An SMA coil spring 3 having an upper hook engaged to the housing 1 and a lower hook engaged to the movable body 2 is arranged in the housing 1, and a weight 4 is incorporated in the movable body 2. For restricting the stroke of the movable body 2, stoppers 5 and 6 are employed, thereby restricting the extent of elongation of the SMA coil spring 3.

Figure 7:
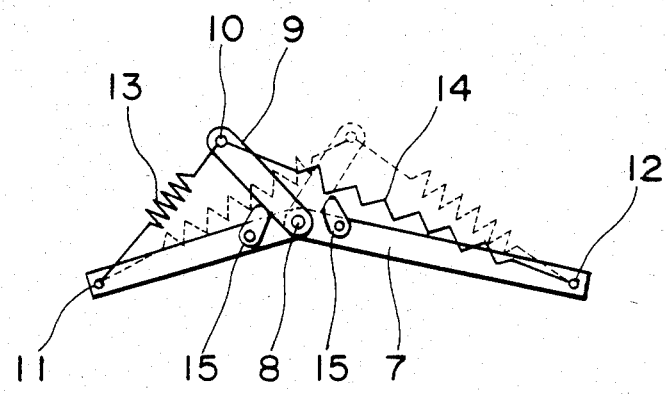
FIG. 7 shows a schematic representation of another thermally actuated device designed to restrict the working distance.

In the example shown in FIG. 7, there is shown an SMA coil springs 13 and a usual coil spring 14, the SMA coil spring 13 being mounted so as to extend between the tip 10 of a movable rod 9 pivotally connected at 8 to an elongated body 7 and one end 11 of the body 7 while the usual coil spring 14 is mounted so as to extend between the tip 10 of the movable rod 9 and the other end 12 of the body 7. The stroke of pivotal movement of the movable rod 9 about the point 8 is restricted by stoppers 15.

Shown in FIGS. 6 and 7 is the drawing showing the principle of restricting the operating range according to the present invention. However, the present invention can be applied to any structure other than those shown respectively in FIGS. 6 and 7 if it is constructed to achieve the restriction in the operating range according to the present invention.

Figure 8:
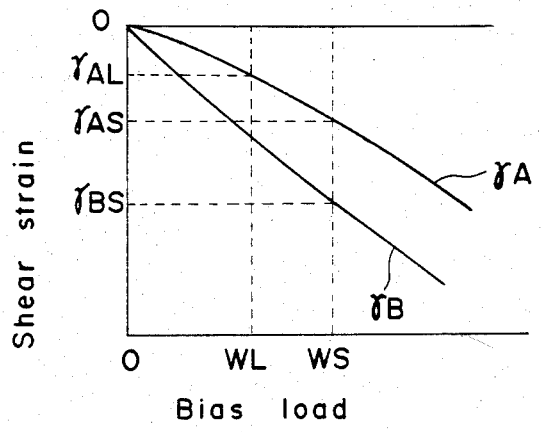
FIG. 8 shows schematically shear strain of $\gamma A$ or $\gamma B$ versus bias load curves explaining the working distance of thermally actuated device.

The operation of the structure shown in each of FIGS. 6 and 7 will be hereinafter described with reference to the drawing of FIG. 8 showing the range of the shear strain. Since the weight employed in FIG. 6 is a dead weight, if the points of intersection between the $\gamma A$ and $\gamma B$ lines and vertical lines drawn to represent the bias load Ws used for a specific purpose are determined, $\gamma Bs$-$\gamma As$ represents the permissible operating range.

In the case of FIG. 7, as the movable rod pivots, the torque given by a usual coil spring (bias spring) changes. Accordingly, both the spring coefficient of the bias spring and the stop positions for the bias spring can be so selected that, when the SMA coil expands at a low temperature, the torque given by the bias spring can become great, but when it contracts at a low temperature, it can become small. In the structure shown in FIG. 7, in order that, even though the force necessary for the bias spring to contract is large when the same bias spring has expanded at a low temperature, the distance between the point of pivot of the movable rod and the center line drawn in the direction of expansion of the bias spring, that is, the torque arm length can be rendered small and, at the same time, the torque can be rendered small, the body 7 is so designed as to bend relative to the point 8 of pivot of the movable rod. By so designing, the force necessary for the SMA coil spring to expand becomes large at a lower temperature, that is, when the SMA coil spring expands (the value being shown by WS), and small (the value being shown by WL) at a high temperature, that is, when the SMA coil spring contracts. Therefore, in FIG. 8, the force corresponds to the case in which the load at the low temperature and that at the high temperature are respectively represented by WS and WL, and the permissible operating range is defined by $\gamma BS$-$\gamma AL$ which is larger than that afforded in the system of FIG. 6.

In the prior art thermally actuated device, attention has been centered on both the large shape recovery capability and the large shape recovery power which the SMA material is featured in, and therefore it has been used under the increased shear strain. Because of this, most of the shape recovery capability is exhibited during the second shape recovery process rather than the first shape recovery process, or as shown in correspondence with FIGS. 6 and 7, the temperature used is not suited to the characteristics of the SMA material even though the shear strain remains the same, and therefore, the hysteresis has been of a relatively great value, for example, 10° C. or greater.

On the contrary thereto, in the thermally actuated device, the operating range is defined in terms of the shear strain of the SMA material and therefore the hysteresis can be reduced to a relatively small value. Accordingly, the present invention can be applied to various machines and instruments such as, for example, temperature setting instruments for constant temperature baths, thermally responsive valves in fluid circuits and fluid deflecting mechanisms for air-conditioners, which have been considered difficult for the SME alloy to control precisely.

Inasmuch as the present invention is subject to many variations, modifications and changes in detail, it is intended that all matters contained in the foregoing description or shown in the accompanying drawings shall be as illustrative and not in a limiting sense.

What is claimed is:

1. A thermally actuated device comprising a shape memory alloy of Ti-Ni base alloy and a counteracting bias load combined together to provide a two-way action, the temperature-deflection relationship at an operating temperature range being such that the shear strain of the shape memory alloy corresponding to the point of transit from a first shape recovery process to a second shape recovery process resulting from the heating is smaller than that corresponding to the point of termination of a first strain induced process by the counteracting bias load resulting from the cooling, the difference between said two shear strains being restricted to the range of operating strain of the shape memory alloy.

2. A device as claimed in claim 1, wherein the operating range is so determined that the maximum amount of deflection of the shape memory alloy from the shape defined by memory-annealing can be equal to or smaller than 2% in terms of the shear strain.

3. A device as claimed in claim 1, wherein the shape memory alloy is a Ti-Ni alloy and has been memory-annealed at a temperature within the range of 425° to 500° C.

4. A device as claimed in claim 1, wherein the shape memory alloy is a Ti-Ni alloy and is shaped into a coil spring.

* * * * *